US009488385B2

(12) United States Patent
Kang

(10) Patent No.: US 9,488,385 B2
(45) Date of Patent: Nov. 8, 2016

(54) HEATER INCLUDING ELECTRICAL LEAKAGE BREAKER CIRCUIT, METHOD OF BREAKING ELECTRICAL LEAKAGE USING THE SAME, AND BIDET INCLUDING THE SAME

(75) Inventor: Tae-Kyung Kang, Seoul (KR)

(73) Assignee: Woongjin Coway Co., Ltd (KR)

( * ) Notice: Subject to any disclaimer, the term of this patent is extended or adjusted under 35 U.S.C. 154(b) by 918 days.

(21) Appl. No.: 13/806,001

(22) PCT Filed: Jun. 23, 2011

(86) PCT No.: PCT/KR2011/004596

§ 371 (c)(1),
(2), (4) Date: Dec. 20, 2012

(87) PCT Pub. No.: WO2011/162559

PCT Pub. Date: Dec. 29, 2011

(65) Prior Publication Data

US 2013/0091627 A1 Apr. 18, 2013

(30) Foreign Application Priority Data

Jun. 24, 2010 (KR) ..... 10-2010-0060226
Jun. 22, 2011 (KR) ..... 10-2011-0060747

(51) Int. Cl.
*H05B 1/02* (2006.01)
*F24H 9/20* (2006.01)
(Continued)

(52) U.S. Cl.
CPC ..... *F24H 9/2014* (2013.01); *A47K 3/26* (2013.01); *E03D 9/08* (2013.01); *H05B 1/0252* (2013.01); *A47K 13/305* (2013.01)

(58) Field of Classification Search
CPC . F24H 9/2014; H05B 1/0235; H05B 1/0236; A47K 3/26; A47K 13/305; H05H 1/0252; E03D 9/08
USPC ..... 219/494, 497, 517, 519, 481; 4/213, 4/217, 420.4
See application file for complete search history.

(56) References Cited

U.S. PATENT DOCUMENTS 2,326,149 A * 8/1943 Light ..... H02H 9/08 307/105
3,781,520 A * 12/1973 Gardom ..... F24H 1/103 200/81.9 R (Continued)

FOREIGN PATENT DOCUMENTS

CN 2165381 5/1994
CN 2313981 4/1999

(Continued)

OTHER PUBLICATIONS

PCT/ISA/237 Written Opinion issued on PCT/KR2011/004596 (pp. 4).
PCT/ISA/210 Search Report issued on PCT/KR2011/004596 (pp. 3).

*Primary Examiner* — Mark Paschall
(74) *Attorney, Agent, or Firm* — The Farrell Law Firm, P.C.

(57) ABSTRACT

A heater includes: a power source for supplying power; a heating section for receiving power from the power source and converting the received power into heat energy; an electrical leakage breaker circuit for cutting off a power transfer from the power source to the heating section; and a control section for receiving leaked current information from the electrical leakage breaker circuit and operating the electrical leakage breaker circuit when the leaked current amount exceeds a preset amount or electrical leakage breaker state information is stored, wherein when the power transfer is cut off, the control section stores the electrical leakage breaker state information.

2 Claims, 2 Drawing Sheets

(51) Int. Cl.

| | |
|---|---|
| ***A47K 3/26*** | (2006.01) |
| ***E03D 9/08*** | (2006.01) |
| *A47K 13/30* | (2006.01) |

(56) References Cited

U.S. PATENT DOCUMENTS

| | | | | |
|---|---|---|---|---|
| 4,029,937 | A * | 6/1977 | Russell | F24H 1/106 219/497 |
| 2004/0019962 | A1* | 2/2004 | Sato | A61H 33/6047 4/420.4 |
| 2005/0225909 | A1 | 10/2005 | Yoshizaki et al. | |
| 2006/0236559 | A1 | 10/2006 | Mori | |
| 2008/0040842 | A1* | 2/2008 | Sanabria | A47K 13/307 4/213 |
| 2010/0095443 | A1 | 4/2010 | Nishimura et al. | |

FOREIGN PATENT DOCUMENTS

| | | |
|---|---|---|
| CN | 1680821 | 10/2005 |
| CN | 101316039 | 12/2008 |
| CN | 201464940 | 5/2010 |
| JP | 2914154 | 6/1999 |
| JP | 2007-124809 | 5/2007 |
| KR | 1020050037544 | 4/2005 |
| KR | 1020060041369 | 5/2006 |
| KR | 1020060069297 | 6/2006 |
| KR | 1020090020219 | 2/2009 |
| KR | 1020090117857 | 11/2009 |
| KR | 1020090119786 | 11/2009 |

* cited by examiner

HEATER INCLUDING ELECTRICAL LEAKAGE BREAKER CIRCUIT, METHOD OF BREAKING ELECTRICAL LEAKAGE USING THE SAME, AND BIDET INCLUDING THE SAME

TECHNICAL FIELD

The present invention relates to a heater including an electrical leakage breaker circuit and a method of breaking electrical leakage using the electrical leakage breaker circuit.

BACKGROUND ART

In general, a home power distributor is provided with an electrical leakage breaker in order to avoid over-current from flowing and fire from breaking out. However, the electrical leakage breaker may only operate when a total amount of current consumed by all home appliances which are electrically connected to the power distributor exceeds a preset level, and thus there may be limitations in ensuring the safety of respective home appliances.

In addition, when electrical current leaks in a heater provided with an electrical leakage breaker circuit, a power supply path of a heating section is cut off to stop power supply to the heater. However, in this case when the power is reset, electrocution may occur due to a re-supply of power.

DISCLOSURE OF INVENTION

Technical Problem

An aspect of the present invention provides a heater including an electrical leakage breaker circuit, a method of breaking electrical leakage of the same, and a bidet including the same, which are capable of determining whether individual heaters are leaking electricity, thereby preventing a fire from breaking out.

Solution to Problem

According to an aspect of the present invention, there is provided a heater including: a power source for supplying power; a heating section for receiving power from the power source and converting the received power into heat energy; an electrical leakage breaker circuit for cutting off a power transfer from the power source to the heating section; and a control section for receiving leaked current information from the electrical leakage breaker circuit and operating the electrical leakage breaker circuit when the leaked current amount exceeds a preset amount, or operating the electrical leakage breaker circuit when electrical leakage breaker state information is stored, wherein when the power transfer is cut off, the control section stores the electrical leakage breaker state information.

The heater may further include a storage section for receiving the electrical leakage breaker state information from the control section and storing the received electrical leakage breaker state.

The storage section may include a storage element or a storage device which keeps the storage information even when the power source is cut off, wherein the electrical leakage breaker state information is stored in the storage element or the storage device.

The storage element may be implemented as a non-volatile memory.

The heater may include a display section which visually displays or acoustically notifies whether the power transfer is cut off or not.

The control section may operate the electrical leakage breaker circuit to prevent the heater from consuming power when the heater is not operated.

According to another aspect of the present invention, there is provided a method for breaking current leakage in a heater including an electrical leakage breaker circuit, including: confirming whether the heater is operating or not, referring to the electrical leakage breaker state information in the heater; heating to produce heat energy using the heater when the heater is operating; determining whether current or voltage which is supplied to the heater during the heating is within a preset range or not; operating the electrical leakage breaker circuit and cutting off the power source when the heater is not in an operating state, or the current or voltage supplied to the heater is out of a preset range; and storing heater electrical leakage breaker state information when the power source of the heater is cut off.

The storing of electrical leakage breaker state information may be performed on a storage element or a storage device which stores the state information even the power source is cut off.

The method may further include visually displaying or acoustically notifying whether the power source of the heater is cut off or not.

The method may further include: stopping an operation of the electrical leakage breaker circuit and releasing power source cut off when an input for releasing the electrical leakage breaker state is received from a user; and releasing a cut off state which includes a step of storing the electrical leakage breaker state information of the heater when power source cut off is released pursuant to input from a user.

The method may further include operating the electrical leakage breaker circuit to prevent the heater from consuming power and saving power when the heater is not operated.

According to another aspect of the present invention, there is provided a bidet including: a power source for supplying power; a heating section for receiving power from the power source and heating washing water; an electrical leakage breaker circuit for cutting off a power transfer from the power source to the heating section; and a control section for receiving leaked current information from the electrical leakage breaker circuit and operating the electrical leakage breaker circuit when the leaked current amount exceeds a preset amount, or operating the electrical leakage breaker circuit when electrical leakage breaker state information is stored, wherein when the power transfer is cut off, the control section stores the electrical leakage breaker state information.

According to another aspect of the present invention, there is provided a bidet including: a power source for supplying power; a toilet seat having a heater which is heated through power received from the power source; an electrical leakage breaker circuit for cutting off a power transfer from the power source to the heater; and a control section for receiving leaked current information from the electrical leakage breaker circuit and operating the electrical leakage breaker circuit when the leaked current amount exceeds a preset amount, or operating the electrical leakage breaker circuit when electrical leakage breaker state information is stored, wherein when the power transfer is cut off, the control section stores the electrical leakage breaker state information.

Advantageous Effects of Invention

In the heater including the electrical leakage breaker circuit, the method of breaking electrical leakage of the same, and the bidet including the same according to the embodiments of the present invention, it is possible to determine whether individual heaters are leaking electricity and cutting off power in a re-operation because state information is stored even when it is determined as electrical leakage.

In the heater including the electrical leakage breaker circuit, the method of breaking electrical leakage of the same, and the bidet including the same according to the embodiments of the present invention, the re-operation can be performed even when the electrical leakage breaker state is released by the user, thereby preventing electrical shock accident caused by electrical leakage of the heater.

BRIEF DESCRIPTION OF DRAWINGS

The above and other aspects, features and other advantages of the present invention will be more clearly understood from the following detailed description taken in conjunction with the accompanying drawings, in which.

BEST MODE FOR CARRYING OUT THE INVENTION

Figure 1:
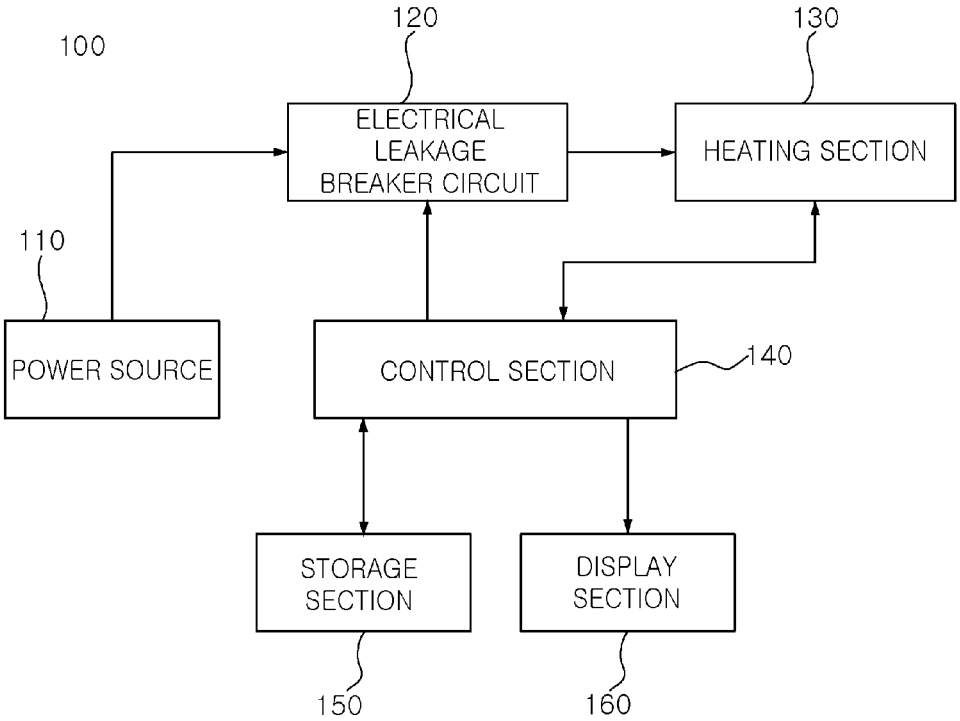
FIG. 1 is a functional block diagram of a heater including an electrical leakage breaker circuit according to an embodiment of the present invention.

Exemplary embodiments of the present invention will now be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art. Like reference numerals in the drawings denote like elements, and thus their description will be omitted.

Also, the terms "comprise," "comprising," "include," "including," and "includes", when used in this specification and in the following claims, are intended to specify the presence of stated features, integers, components, or steps, but they do not preclude the presence or addition of one or more other features, integers, components, steps, acts, or groups.

FIG. 1 is a functional block diagram showing a heater provided with an electrical leakage breaker circuit according to an embodiment of the present invention.

Referring to FIG. 1, the heater 100 according to the embodiment of the present invention may include a power source section 110, an electrical leakage breaker circuit 120, a heating section 130 and a control section 140, and may further include a storage section 150. Additionally, the heater 100 according to the embodiment of the present invention may further include a display section 160.

The power source section 110 may supply power to the heating section 130 for the operation thereof. The power source section 110 may include a rectifier, a voltage converter, a power factor converter, and the like, to supply appropriate power for a configuration of the heating section 130.

The heating section 130 may convert electrical energy supplied from the power source section 110 to heat energy. At this time, the heating section 130 may use generally resistive elements for converting electrical energy to heat energy.

The electrical leakage breaker circuit 120 may electrically connect the power source section 110 to the heating section 130 and supply power from the power source section 110 to the heating section 130, or break the power.

A general electrical leakage breaker circuit may include an electrical leakage detector, a zero-phase current transformer, and a breaker, etc. The electrical leakage breaker circuit may allow leaked current to return to the power source through a ground when current is leaked at a load side. Accordingly, there may be a current difference amount equal to the leaked current between an outward current and a return current which pass through the zero-phase current transformer. Therefore, a magnetic flux corresponding to the leaked current amount may be produced on an iron core and output in proportion to the leaked current amount may be created on a secondary side of the zero-phase current transformer. A breaking mechanism may be operated using the output to open a main contact.

However, the electrical leakage breaker circuit according to the embodiment of the present invention may be implemented using only an electrical leakage detector and a breaker wherein the breaker is controlled through the control section 140.

The control section 140 may control operations of the heating section 130 and the electrical leakage breaker circuit 120. That is, the control section may control an amount of power supplied to the heating section 130 or an operation extent of the heating section 130 to achieve a desired temperature and may further control the breaker to cut off the power supplied from the power source section 110 to the heating section when leaked current is detected in the electrical leakage breaker circuit 120. Furthermore, prior to supplying power to the heating section 130, the control section 140 may determine that current is leaked in the heating section 130 and not supply power when electrical leakage breaker state information is stored. That is, when a state of power cut or power breaking by a user is released, the control section may confirm whether there has been power cut in the heating section 130 and allow a state of power supply cut to be kept.

As one example of an electrical leakage break method, the control section 140 may receive leaked current information from the electrical leakage breaker circuit 120 and allow the electrical leakage breaker circuit 120 to be operated to cut off power supply to the heating section 130 when the leaked current amount exceeds a preset current amount.

Additionally, the controller 140 may store current leakage state information in the heater 100 to keep a power source state when a current leakage state in the heater 100 is not settled consistent. In particular, the current leakage state information in the heater 100, which is stored in the control section 140, is kept even when power source of the heater 100 is cut off entirely.

When the control section 140 stores the current leakage state information in the heater 100 as previously mentioned, the state of an electrical leakage breaker state in the heater 100 can be stored even if the power source is cut off entirely and then re-operated after current in the heater 100 is leaked and cut off. In a case of a general heater, when the whole power source is cut off, a function of the control section 140 is to be reset and thus an electrical leakage state of the heater is released when it is re-operated, causing an electrical short or an electrical shock from the heater. The problems of electrical shorts or leakages are not to be solved by only temporarily cutting off power but also by accompanying tasks such as repair or replacement, etc. As a result, the electrical leakage breaker state has to be kept until a task such as repair or replacement, or the like, is undertaken or a separate releasing order of electrical leakage state is received even after power is supplied to the control section 140 or the control section 140 breaks electrical leakage.

The storage section 150 may include a storage element or a storage device which can keep the storage information even in a case of the power source being cut off. That is, a function for storing an electrical leakage breaker state in the control section 140 may be implemented through the storage section 150 provided with a separate storage element or a storage device. The information of electrical leakage breaker state may preferably be stored in the storage element or storage device.

The storage element may include a non-volatile memory since the stored information is retained even when power is cut off. The non-volatile memory may include EEPROM and flash memory. Here, data can be easily electrically written and erased on the EEPROM which has ROM-like properties, and thus, data can be kept thereon even when power is not supplied. Additionally, a flash memory has a large storage space and thus when it is used as a memory for a main control unit (MCU), a part of the flash memory may be allocated for storing electrical leakage breaker state information, implementing the storage section 150.

The display section 160 may visually display or acoustically notify whether power supply to the heating section 130 is cut off or not. Furthermore, the display section 160 may include an operating panel for a user to operate the heater 100 and may display operating information.

In particular, recent heaters may include electronic systems for supporting various operation modes. The electronic systems may be generally embedded and preferably be provided with a ROM which stores a program for operating between processors. When the heater is manufactured, the ROM may use an EEPROM or a flash memory on which data can easily stored or corrected.

Therefore, the heater 100 according to the embodiment of the present invention, which is configured as previously mentioned, may be implemented using the storage section 150 which is generally embedded into a product. That is, the heater may be implemented by adding only circuit which gives and receives signal to the electrical leakage breaker circuit 120. Additionally, since a failure mode in a state of a product is displayed even when current is leaked, a safe accident caused by a user's carelessness can be prevented. That is, the heater 100 can be manufactured by an extremely low added cost, which ensures the safety of an electrical leakage breaker and a user's safety.

Additionally, the control section 140 may allow the electrical leakage breaker circuit 120 to be operated when an operation of the heater 100 is unnecessary and cut off the power supplied to the heating section 130, decreasing unnecessary power consumption. That is, the control section may perform a power control function.

Meanwhile, when the control section 140 may receive an input for releasing an electrical leakage breaker state from a user, it may stop an operation of the electrical leakage breaker circuit 120, and alter and store information of the electrical leakage breaker state in the heater 100. When a user may check or confirm an electrical leakage breaker state through this mechanism, the heater 100 may be operated normally.

Figure 2:
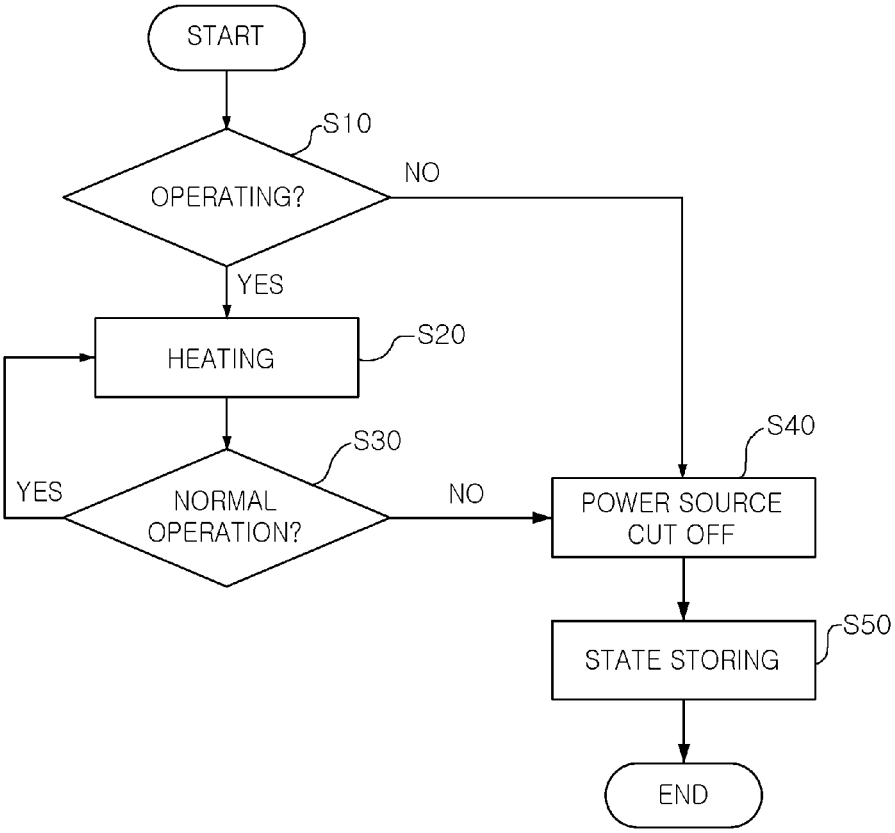
FIG. 2 is a flowchart showing a control method using the heater including the electrical leakage breaker circuit according to an embodiment of the present invention.

FIG. 2 is a flowchart showing an electrical leakage break method using the heater provided with the electrical leakage breaker circuit according to an embodiment of the present invention.

Referring to FIG. 2, since it may be confirmed whether the heater 100 is in an electrical leakage breaker state prior to driving the heater 100, referring to the storage information, an electrical short or an electrical shock can be prevented, which may be caused from a resetting of an electrical leakage breaker state of the heater 100 when the heater 100 is re-operated.

First, prior to a start of an operation of the heater 100, a process S10 of confirming whether the heater 100 is operating or not is performed, referring to the information of electrical leakage breaker state of the heater 100. That is, prior to supplying of power to the heating section 130, it may be determined that current is leaked in the heating section 130 when the electrical leakage breaker state information is stored, and power may not be supplied. The reason of power not being supplied is that when the control section 140 has been in a state of electrical short or power cut off by a user and released from that state, it may be confirmed whether the heating section 130 has electrically shorted, and power supply cut off state has to be kept.

When the heater 100 may be operating, a heating process S20 which produces heat energy using the heater 100 may be performed.

A process S30 of determining whether current or voltage supplied to the heater 100 during the heating process is within a preset level or not may be undertaken. Through the determining process it may be confirmed whether the heater 100 is operated normally or current in the heater 100 is leaked. The determining process S30 may be performed periodically or intermittently during a heating operation.

When the heater 100 may not be operating or the current or voltage supplied to the heater 100 may be out of a preset range, the electrical leakage breaker circuit 120 may be operated and a process S40 of cutting off the power of the heater 100 may be performed.

When the power of the heater 100 is cut off, a process S50 of storing electrical leakage breaker state information may be performed.

According to the control method performed as previously mentioned, even when the heater 100 is re-started after a power source has been cut off entirely, the electrical leakage breaker state can be kept, preventing an electrical short or an electrical shock.

Meanwhile, a process may be further performed to visually display or acoustically notify whether a power source of the heater 100 is cut off or not, which is not shown in the drawing.

Figure 3:
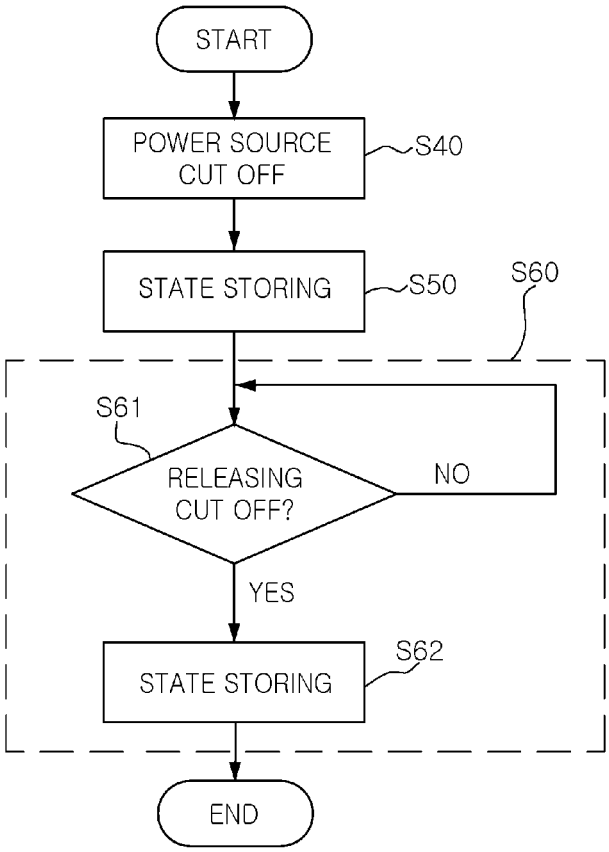
FIG. 3 is a flowchart showing a process of releasing electrical leakage breaker state in the control method using the heater including the electrical leakage breaker circuit according to an embodiment of the present invention.

FIG. 3 is a flowchart showing a process of releasing an electrical leakage breaker state in the electrical leakage breaking method in the heater including the electrical leakage breaker circuit according to an embodiment of the present invention.

Referring to FIG. 3, the process S60 of releasing an electrical leakage breaker state is performed when the electrical leakage breaker circuit 120 of the heater 100 is operated to cut off power source of the heater 100.

When the heater 100 is not in an operating state, or current or voltage supplied to the heater 100 is out of a preset range, the electrical leakage breaker circuit 120 is operated to perform a power source cut off process S40.

When the power source of the heater 100 is cut off, a process S50 of storing the electrical leakage breaker state information of the heater 100 is performed.

After the above two processes S40 and S50 are performed, a process S60 of releasing the electrical leakage breaker state is performed.

When an input for releasing the electrical leakage breaker state is received from a user, an operation of the electrical leakage breaker circuit 120 is stopped to perform a process S61 of releasing power source cut off.

When power source cut off is released pursuant to a user's input, a process S62 of storing an electrical leakage breaker state of the heater 100 is performed.

Additionally, although not shown in the drawing, according to the control method of the present invention, when the heater 100 is not operated, a power-saving process may be further performed such that the electrical leakage breaker circuit 120 is operated to prevent power consumption by the heater 100.

Meanwhile, even though shown in the drawing, the heater 100 according to the embodiment of the present invention may be applicable to a bidet. In general, there are two kinds of heaters in a bidet, one of which heats washing water which is used for washing or a bidet, and the other of which heats a toilet seat. However, two heaters may be in danger when current is leaked or an electrical short is produced, and thus, the heater 100 according to the embodiment of the present invention may be preferably applicable.

One embodiment of a bidet to which the heater of the present invention is applicable may include a power source for supplying power, a heating section for receiving the power from the power source and heating washing water, an electrical leakage breaker circuit for cutting off power transfer from the power source to the heating section, and a control section which receives leaked current information from the electrical leakage breaker circuit and operates the electrical leakage breaker circuit when the leaked current amount exceeds a preset amount or electrical leakage breaker state information is stored wherein when the power transfer is cut off, the control section may store the electrical leakage breaker state information.

Another embodiment of a bidet to which the heater of the present invention is applicable may include a power source for supplying power, a toilet seat section having a heater which receives power from the power source and is heated, an electrical leakage breaker circuit for cutting off power transfer from the power source to the heater, and a control section which receives leaked current information from the electrical leakage breaker circuit and operates the electrical leakage breaker circuit when the leaked current amount exceeds a preset amount or electrical leakage breaker state information is stored, wherein when the power transfer is cut off, the control section may store the electrical leakage breaker state information.

As set forth above, according to exemplary embodiments of the invention, the heater according to the present invention may break safely current leakage and be applicable to a toilet seat or adopted as a heater for producing warm water.

While the present invention has been shown and described in connection with the exemplary embodiments, it will be apparent to those skilled in the art that modifications and variations can be made without departing from the spirit and scope of the invention as defined by the appended claims.

The invention claimed is:

1. A bidet comprising:

a power source for supplying power;

a heating section for receiving power from the power source and heating washing water;

an electrical leakage breaker circuit for cutting off a power transfer from the power source to the heating section; and a control section for receiving information of leaked current from the electrical leakage breaker circuit and operating the electrical leakage breaker circuit when electrical leakage breaker state information is stored, wherein when the power transfer is cut off, the control section stores the electrical leakage breaker state information.

2. A bidet comprising:

a power source for supplying power;

a toilet seat having a heater which is heated through power received from the power source;

an electrical leakage breaker circuit for cutting off a power transfer from the power source to the heater; and a control section for receiving leaked current information from the electrical leakage breaker circuit and operating the electrical leakage breaker circuit when electrical leakage breaker state information is stored, wherein when the power transfer is cut off, the control section stores the electrical leakage breaker state information.

* * * * *